US008978285B1

(12) United States Patent
Burke et al.

(10) Patent No.: US 8,978,285 B1
(45) Date of Patent: Mar. 17, 2015

(54) ANTI-RATTLE COLLAPSIBLE BUTTSTOCK

(71) Applicants: Judd Burke, Xenia, OH (US); Matthew Vallo, Dayton, OH (US)

(72) Inventors: Judd Burke, Xenia, OH (US); Matthew Vallo, Dayton, OH (US)

( * ) Notice: Subject to any disclaimer, the term of this patent is extended or adjusted under 35 U.S.C. 154(b) by 0 days.

(21) Appl. No.: 13/971,341

(22) Filed: Aug. 20, 2013

(51) Int. Cl.
*F41C 23/14* (2006.01)
*F41C 23/04* (2006.01)
*F41C 23/20* (2006.01)

(52) U.S. Cl.
CPC ..... *F41C 23/04* (2013.01); *F41C 23/14* (2013.01); *F41C 23/20* (2013.01)
USPC ..... 42/73; 42/74

(58) Field of Classification Search
CPC ..... F41C 23/20; F41C 23/14; F41C 23/06; F41C 23/04
USPC ..... 42/75.03, 73, 74
See application file for complete search history.

(56) References Cited

U.S. PATENT DOCUMENTS 6,543,172 B1 4/2003 Armstrong
6,651,371 B2 11/2003 Fitzpatrick et al.
7,398,616 B1 7/2008 Weir
7,640,690 B2 1/2010 Hines
7,823,313 B2 * 11/2010 Faifer ..... 42/74
8,191,299 B2 6/2012 Faifer
8,327,569 B2 12/2012 Kincel
2006/0096148 A1 * 5/2006 Beretta ..... 42/74

FOREIGN PATENT DOCUMENTS

EP 2711660 * 3/2014

* cited by examiner

*Primary Examiner* — Stephen M Johnson
(74) *Attorney, Agent, or Firm* — Dinsmore & Shohl LLP

(57) ABSTRACT

An apparatus for an anti-rattle assembly for a collapsible buttstock for a firearm may include a baseplate with a plurality of lower guides and a plurality of fasteners wherein the plurality of fasteners removably secure the anti-rattle assembly to a plurality of fastener positions of a buttstock body. The anti-rattle assembly may further include a pressure plate with one or more ridges to engage one or more rail surfaces of a receiver extension and a plurality of upper guides and a plurality of biasing members wherein the pressure plate is vertically aligned with the baseplate and the plurality of biasing members are coupled between the upper guides and the lower guides and bias the one or more ridges against the one or more rail surfaces. The anti-rattle assembly restricts the movement of the receiver extension in a tubular aperture of the buttstock body.

19 Claims, 6 Drawing Sheets

ANTI-RATTLE COLLAPSIBLE BUTTSTOCK

TECHNICAL FIELD

The invention relates generally to buttstocks for attachment to firearms, and more particularly to a buttstock assembly that has an improved slide lock mechanism which provides an anti-rattle assembly.

BACKGROUND

For several military applications and/or operational groups, weapons may need to be collapsible for ease of transportation to a field venue, and then easily assembled in the field. For example, rifles are frequently designed to be collapsible. One typical portion of a collapsible rifle assembly is the buttstock that forms the aft-most part of the assembled rifle, which is received and covers a recoil absorption appendage, or "receiver extension." In general, modern conventional buttstocks are ergonomic since the buttstock forms the interface with the user's shoulder area, and adjustable along the receiver extension to further form fit the rifle to the user. One manner in which modern conventional buttstocks are made adjustable is via a slide lock mechanism, which provides a biasing pin that fits into a retaining feature, such as a pin seat or hole, provided along the receiver extension. A number of such pin seats or holes are so provided by the receiver extension to provide multiple adjustment points which are used to either lengthen or shorten the rifle as a user may desire.

SUMMARY

In one embodiment, an apparatus for an anti-rattle assembly for a collapsible buttstock for a firearm may include a baseplate with a plurality of lower guides and a plurality of fasteners wherein the plurality of fasteners removably secure the anti-rattle assembly to a plurality of fastener positions of a buttstock body. The anti-rattle assembly may further include a pressure plate with one or more ridges to engage one or more rail surfaces of a receiver extension and a plurality of upper guides and a plurality of biasing members wherein the pressure plate is vertically aligned with the baseplate and the plurality of biasing members are coupled between the upper guides and the lower guides and bias the one or more ridges against the one or more rail surfaces. The anti-rattle assembly restricts the movement of the receiver extension in a tubular aperture of the buttstock body.

In another embodiment, an apparatus for a collapsible buttstock assembly may include a receiver extension, a buttstock body, and an anti-rattle assembly. The receiver extension may include an outer an alignment rail extending longitudinally along the receiver extension and comprising an elongated slot with a plurality of cavities spaced apart at regular intervals and one or more rail surfaces spanning a length of the alignment rail wherein each rail surface is situated on either side of the plurality of cavities. The buttstock body may include a body axis that runs longitudinally from a first end to a second end, and a tubular aperture with a tubular axis and a groove parallel with the tubular axis and is situated along an outer tube wall of the tubular aperture, the tubular axis is parallel to the body axis, and wherein the tubular axis receives the receiver extension. The buttstock body may further include a locking pin situated in a pin aperture with a pin axis that orthogonally penetrates the groove and wherein the locking pin in the extended position engages a cavity of the plurality of cavities and restricts the movement of the receiver extension, and a pin biasing spring that biases the locking pin into the groove. The buttstock body may further include a lever coupled to the locking pin wherein when the lever is actuated in a first direction, the locking pin is in retracted position and when the lever is in a resting state, the locking pin is in an extended position, and a plurality of fastener positions located around a perimeter wall of a rattle aperture.

In yet another embodiment, a method for reducing movement in a collapsible buttstock may include applying pressure on a receiver extension inserted into a tubular aperture of a buttstock body by using the anti-rattle kit. The method of reducing movement may further include aligning an upper tube portion of the receiver extension with an upper body portion of the tubular aperture with the applied pressure to reduce the movement of the buttstock body in relation to the receiver extension, and maintaining the alignment a tubular axis of the buttstock body with a firearm axis. The anti-rattle kit may include a baseplate with a plurality of lower guides and a plurality of fasteners wherein the plurality of fasteners removably secure the anti-rattle assembly to a plurality of fastener positions of the buttstock body, a pressure plate with one or more ridges to engage one or more rail surfaces of the receiver extension and a plurality of upper guides, and a plurality of biasing members wherein the pressure plate is vertically aligned with the baseplate and the plurality of biasing members are coupled between the upper guides and the lower guides and bias the one or more ridges against the one or more rail surfaces.

These and other features, aspects, and advantages of the present invention will become better understood with reference to the following description and the appended claims.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

An anti-rattle assembly may be used in any type of collapsible firearm stock to reduce the play between a receiver extension of the firearm and a buttstock assembly that is slideably coupled to the receiver extension. The anti-rattle assembly may be mounted to the buttstock assembly and apply pressure to the receiver extension to reduce and/or eliminate any freedom of movement between the receiver extension and the buttstock assembly. The reduction and/or elimination of movement between the receiver extension and the buttstock assembly will reduce and/or eliminate noise from contact between the receiver extension and the buttstock assembly when the firearm is not under tension (e.g. not shouldered and/or in preparation to fire the firearm). In other words, when the firearm is being carried and/or moved, a noise or a rattle may emanate from contact between the receiver extension and buttstock assembly. In the field, such unwanted noise can be to a user's disadvantage by disclosing presence and/or position of the user to an adversary. Alternatively, when the firearm is under tension, (e.g. the firearm is shouldered) the freedom of movement between the receiver extension and buttstock assembly may affect a proper sight picture with a target. In other words, the gaps or space between the receiver extension and the buttstock may allow for the collapsible firearm stock to bend and/or deflect at an interface between the receiver extension and the buttstock assembly thereby allowing for an improper alignment of a user's line of sight with the sights on the firearm for a proper sight picture. As such, it is to be understood that the particular embodiment shown and described herein is merely one example of a suitable firearm and buttstock assembly, and that a firearm and/or buttstock assembly of any other type, kind, configuration, construction and/or arrangement in accordance with the subject matter of the present disclosure could alternately be used.

Figure 1:
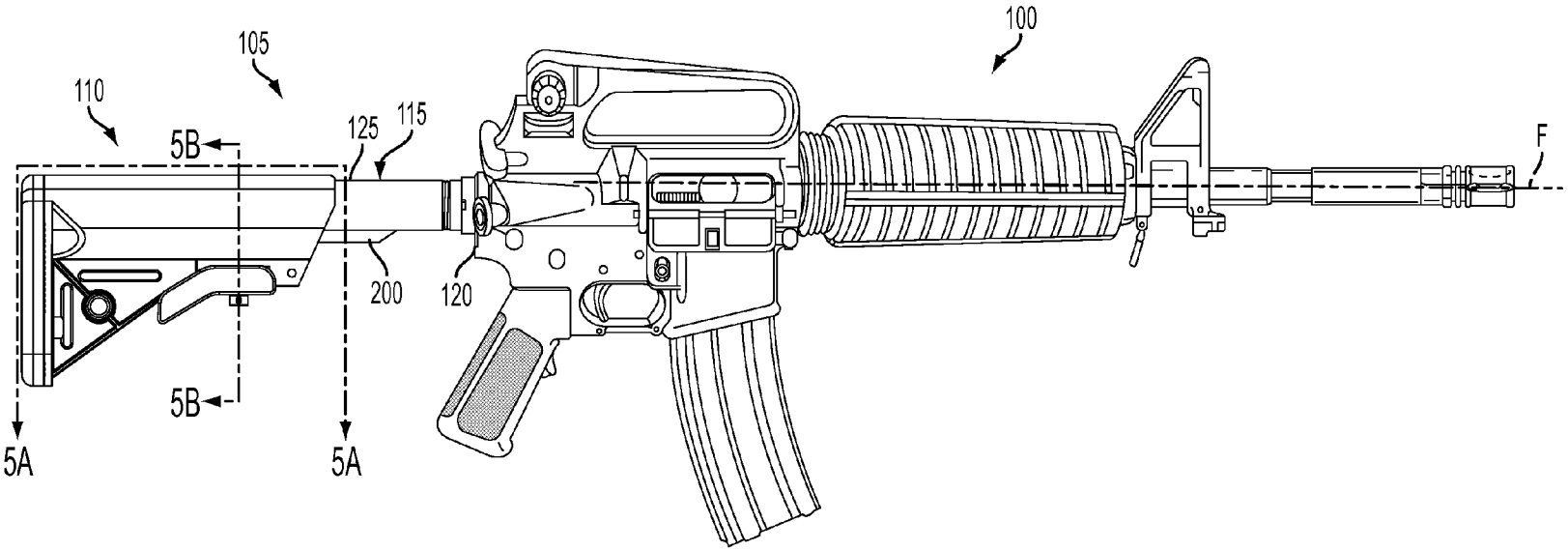
FIG. 1 depicts a firearm with a collapsible buttstock according to one or more embodiments shown and described herein.
Figure 2:
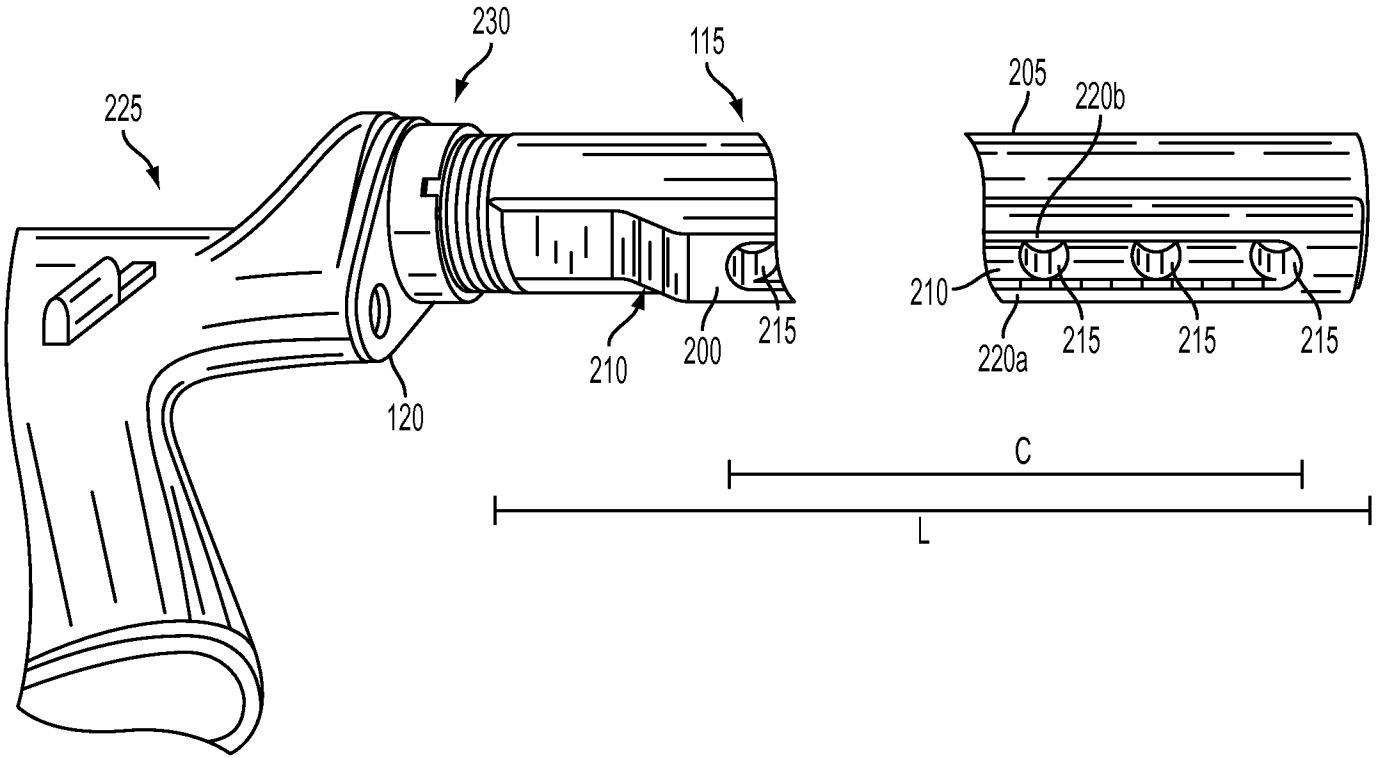
FIG. 2 depicts the receiver extension according to one or more embodiments shown and described herein.

Referring now to FIG. 1, a firearm 100 is shown with a collapsible buttstock 105. The collapsible buttstock 105 may have a buttstock assembly 110 and a receiver extension 115. The receiver extension 115 may slideably couple with the buttstock assembly 110. In other words, the receiver extension 115 may be coupled with the buttstock assembly 110 to allow the buttstock assembly 110 to expand and contract like a telescope in relation to the receiver extension 115. The receiver extension 115 may have an upper tube portion 125 that is opposite an alignment rail 200 on the outer surface 205 (FIG. 2). The buttstock assembly may be removably secured at one or more telescoping positions in relation to an aft end 120 of the firearm 100.

FIG. 2 depicts the receiver extension 115. The receiver extension 115 may have a length L that may vary depending on the configuration of the collapsible buttstock 105. The receiver extension 115 may include the alignment rail 200 that extends longitudinally along the length L of the receiver extension 115. The alignment rail 200 projects radially outwardly from an outer surface 205 and has a somewhat rectangular shaped cross section. An elongated slot 210 is formed into the alignment rail 200 and may include a plurality of cavities 215 provided within the elongated slot 210. The plurality of cavities 215 are shown extending inwardly into the alignment rail 200 and may be disposed in a longitudinally-spaced relation to one another along a length C of the elongated slot 210. The plurality of cavities may be spaced apart at regular intervals and may correspond to one or more telescoping positions. The alignment rail 200 may include one or more rail surfaces 220. In the embodiment shown, the one or more rail surfaces 220 may include a first rail surface 220*a* and a second rail surface 220*b*. In another embodiment, the one or more rail surfaces 220 may include the first rail surface 220*a* and the second rail surface 220*b* in addition to one or more intermediate rail surfaces that may be situated between the plurality of cavities 215. The intermediate rail surfaces may be of the same height as the first rail surface 220*a* and the second rail surface 220*b* and may couple the first rail surface 220*a* to the second rail surface 220*b* between the plurality of cavities 215.

As stated above, the receiver extension 115 may be configured for any length L. With the variation in the length L, the number of the plurality of cavities 215 may also be varied based on the application of the collapsible buttstock 105 (FIG. 1). The number of telescoping positions as discussed above depends on the number of the plurality of cavities. In one example, the plurality of cavities 215 may be as few as two cavities. In another example, the plurality of cavities 215 may be as numerous as twenty cavities. In another embodiment, the plurality of cavities 215 may be as few as four cavities and as numerous as nine cavities. For a given length L, the plurality of cavities 215 may depend on a size and shape of a locking pin 405, which is best shown in FIG. 4A. The length L of the receiver extension 115 may be a standard length; however the locking pin 405 may be smaller than the standard size and shape. This may allow for more plurality of cavities 215 along the length L and allow for more telescoping positions.

The receiver extension 115 may be used to house a recoil assembly (not shown) to allow for operation of the firearm 100. The recoil assembly may include an action spring (not shown) and a buffer assembly (not shown). The receiver extension 115 may be coupled to a firearm body 225 by welding, adhesives, twist lock, or a nut and bolt. In one embodiment, the receiver extension 115 may include a threaded body at one end of the outer surface 205 and the firearm body 225 may include a nut assembly. The threaded body of the receiver extension 115 may threadably couple with the nut assembly of the firearm body 225 and restrict the receiver extension 115 from rotating in relation to the firearm body 225. In another embodiment, the receiver extension 115 may also be a buttstock mount (not shown) that does not serve to house the recoil assembly. The buttstock mount may be coupled to the firearm body 225 and may allow the buttstock assembly 110 to be slideably couple with the firearm 100. The buttstock mount may mimic the features of the receiver extension 115 as shown in FIG. 2.

Figure 3:
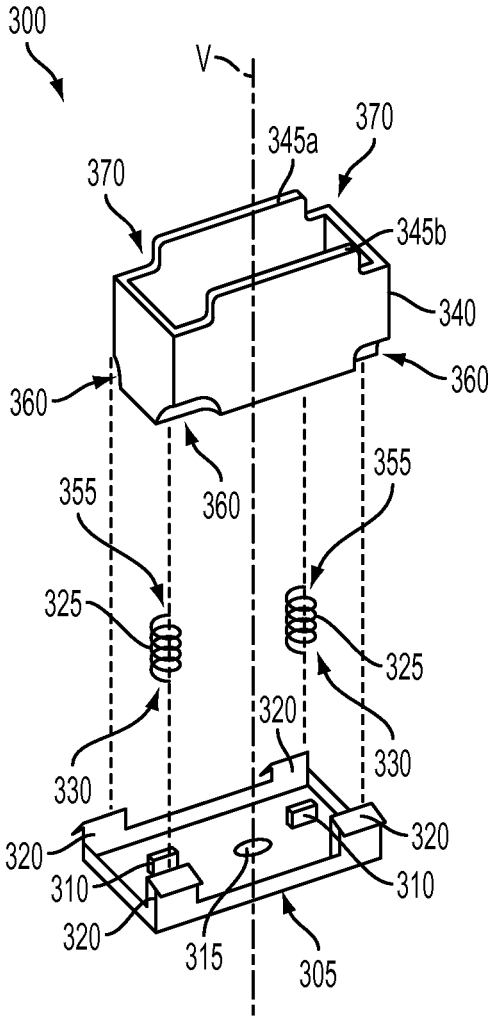
FIG. 3 depicts the components of an anti-rattle assembly according to one or more embodiments shown and described herein.

FIG. 3 depicts the components of the anti-rattle assembly 300. A baseplate 305 may include a plurality of lower guides 310, and a plurality of fasteners 320. The plurality of lower guides 310 may be a vertical structure designed to capture and retain a bottom biasing portion 330, respectively, of a respective biasing member 325. The plurality of fasteners 320 may be used to secure the baseplate 305 to a buttstock body 400 as shown in FIG. 5. Each of the biasing members 325 may be a spring, a compressible foam, a compressible gel, and a compressible fluid. In some embodiments, the baseplate 305 may include a plate aperture 315 to allow the locking pin 405 (best shown by FIG. 4A) to pass through the baseplate 305 unimpeded. In this embodiment, the baseplate 305 may serve as a lower pin biasing guide for a pin biasing spring 410. This would allow the pin biasing spring 410 to provide a biasing force on the locking pin 405 in an upward direction until the locking spring is acted on by a lever 450 as described below.

A pressure plate 340 may be situated vertically above the baseplate 305 as depicted by FIG. 3 along vertical axis V. The pressure plate 340 may include one or more ridges 345*a* and 345*b*, and a plurality of upper guides (FIG. 5A). The one or more ridges 345*a* and 345*b* are configured to contact under a biasing force from the biasing members 325, the one or more rail surfaces 220*a* and 220*b*, respectively, of the receiver extension 115 of FIG. 2. The plurality of upper guides may be vertically aligned with the plurality of lower guides 310, and may be operable to capture and retain an upper biasing portion 355 of the biasing members 325. The lower guides 310 and the upper guides may be operable to ensure that the biasing members 325 remain in an upright and/or vertical position. Each of the biasing members 325 provides a biasing force between the baseplate 305 and the pressure plate 340. As explained below, the baseplate 305 may be coupled to the buttstock body 400 in one embodiment. The biasing force applies pressure along the vertical axis V to the pressure plate 340 and in turn, applies pressure to the one or more rail surfaces 220*a*, 220*b* through the one or more ridges 345*a*, 345*b*. The biasing force, or pressure, applied to the receiver extension 115 creates a contact surface between the upper tube portion 125 of the receiver extension 115 and an upper body portion 415 of a tubular aperture 420 (best shown by FIG. 4B). The contact surface may be of any length to reduce or eliminate movement between the upper tube portion 125 and the receiver extension 115. The biasing force is operable to reduce the movement of the buttstock body 400 in relation to the receiver extension 115. The contact surface allows for the alignment of the upper tube portion 125 of the receiver extension 115 with an upper tube portion 125 of the tubular aperture with the applied pressure to reduce the movement of the buttstock body in relation to the receiver extension 115 and to maintain the alignment a tubular axis of the buttstock body 400 with a firearm axis F of the firearm 100 of FIG. 1. By maintaining the alignment of the buttstock body 400 with the firearm 100, a user is able to maintain a sight picture and a cheek weld with the collapsible buttstock 105 with the need to readjust because of a shift of the buttstock body 400 in relation to the firearm 100.

If the alignment rail 200 has the intermediate rail surfaces as described above, the one or more ridges 345*a*, 345*b* of the pressure plate 340 may include an intermediate ridge to contact and apply a biasing force or pressure to the receiver extension 115. The intermediate ridge may span the distance between the one or more ridges 345*a*, 345*b* to contact the intermediate rail surfaces or the intermediate ridge may be a solid surface running the length of the one or more ridges. If the intermediate ridge is solid, a second plate aperture may be present and aligns with the plate aperture 315 of the base plate to allow the locking pin 405 to slideably couple with the pressure plate 340.

A plurality of fastener apertures 360 may be included in the pressure plate 340 to allow for the movement of the pressure plate 340 along the vertical axis V without interference from the plurality of fasteners 320 being coupled to the buttstock body 400. Referring to FIG. 4A, when the baseplate 305 is coupled to the buttstock body 400 (i.e. the plurality of fasteners 320 coupled to a plurality of fastener positions 460 (same on opposite, non-depicted side of buttstock body 400), respectively, the plurality of fasteners 320 may restrict the movement of the pressure plate 340 along the vertical axis V. The plurality of fastener apertures 360 may allow for the movement of the pressure plate 340 without interference from the plurality of fasteners 320.

The pressure plate 340 may also include one or more lower stops 370. The buttstock body 400 may include one or more upper stops 500 of FIG. 5A. When the one or more lower stops 370 and the one or more upper stops 500 are making contact, the pressure plate 340 is at an uppermost position along the vertical axis V. For example, when the receiver extension 115 is slideably coupled with the tubular aperture 420, the one or more rail surfaces 220 of the alignment rail 200 exert a downward force in the direction of the vertical axis V on the pressure plate 340. While the receiver extension 115 is slideably coupled with the tubular aperture 420 of the buttstock body 400, the one or more upper stops 500 are not in contact with the one or more lower stops 370 i.e., a gap 590 exist between the lower and upper stops 370, 500 as depicted by FIG. 5C. When the receiver extension 115 is removed from the tubular aperture 420 of the buttstock body 400, the one or more upper stops 500 are in contact with the one or more lower stops 370 due to the biasing force apply by biasing members 325 (FIG. 5A) to move the one or more lower stops 370 into contact with the one or more upper sops 500.

Figure 4B:
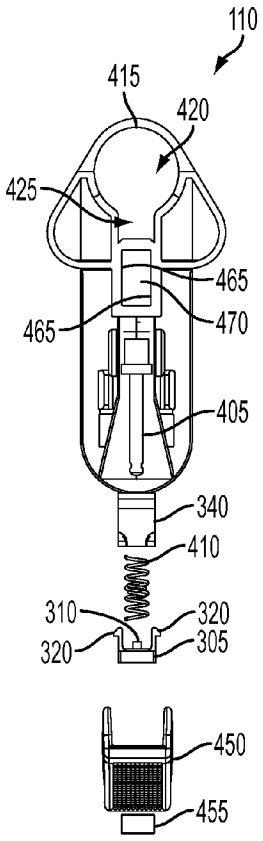
FIG. 4B depicts a front view of the anti-rattle assembly in relation to a buttstock body according to one or more embodiments shown and described herein.
Figure 4A:
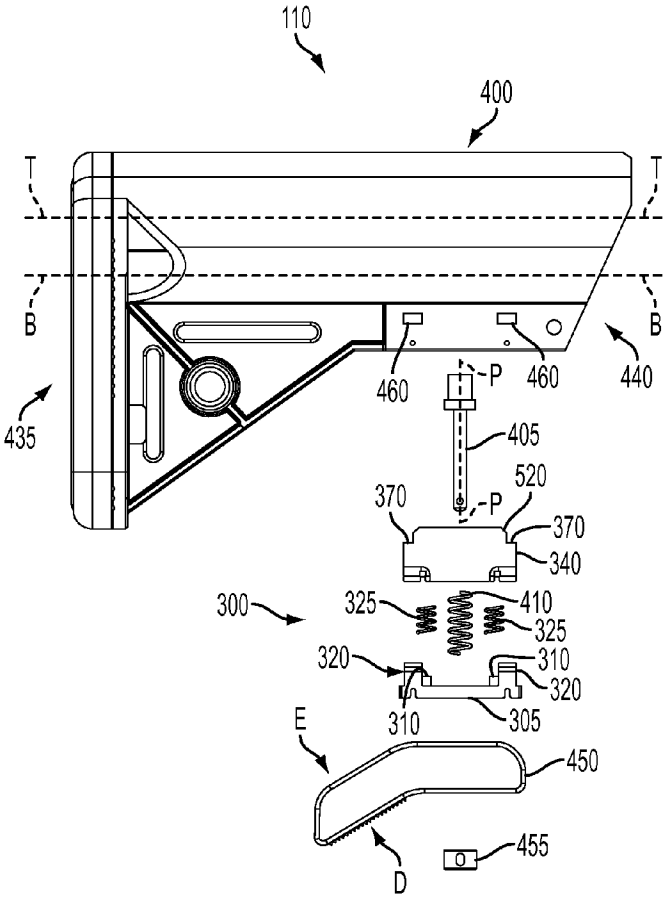
FIG. 4A depicts a right side view of the anti-rattle assembly in relation to a buttstock body according to one or more embodiments shown and described herein.
Figure 5A:
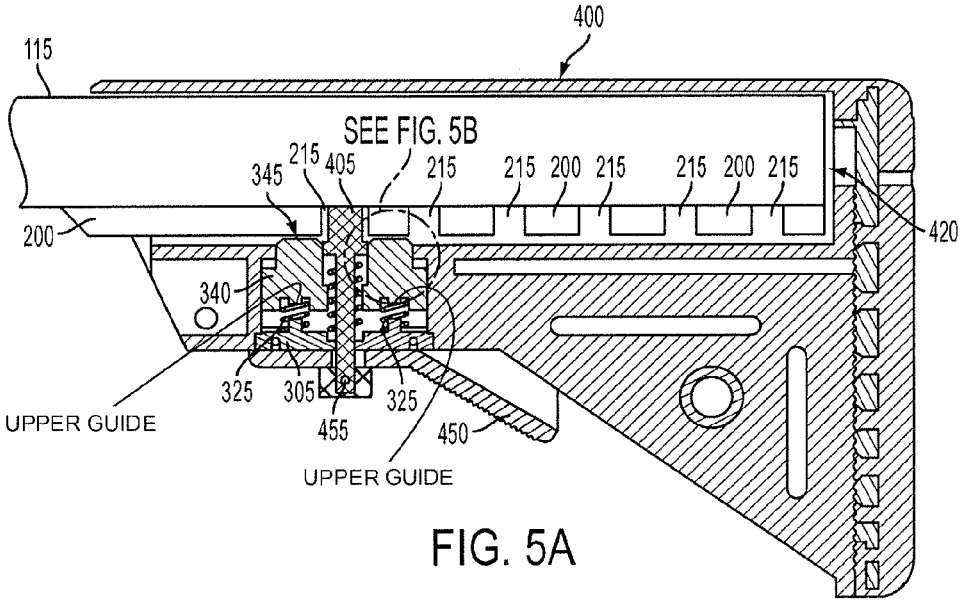
FIG. 5A depicts a cross-section view taken along line 5A-5A shown in FIG. 1, of the anti-rattle assembly within a rattle aperture within the buttstock body according to one or more embodiments shown and described herein.
Figure 5B:
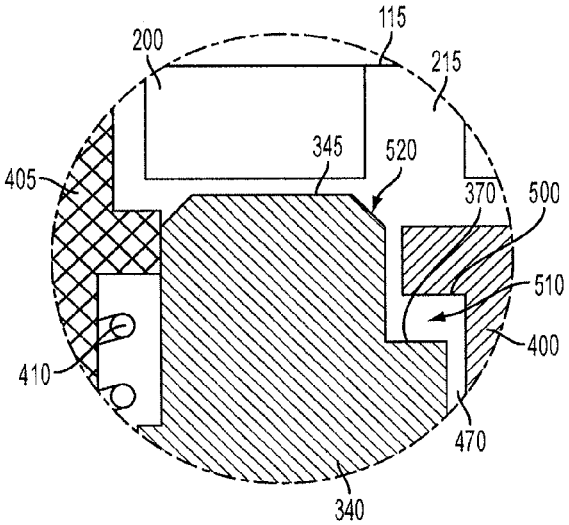
FIG. 5B depicts a close-up section view shown in FIG. 5A, of the anti-rattle assembly within a rattle aperture within the buttstock body according to one or more embodiments shown and described herein.
Figure 5C:
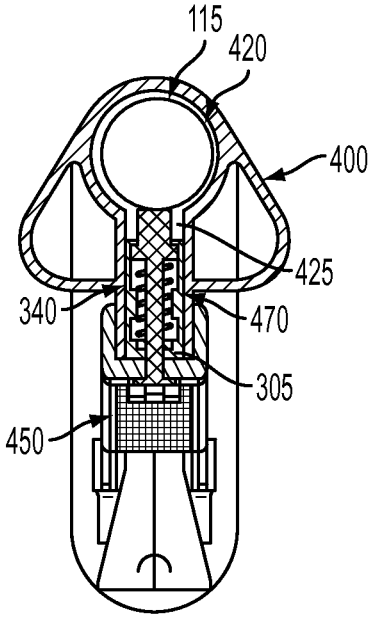
FIG. 5C depicts a cross-section view taken along section line 5B-5B shown in FIG. 1, of the anti-rattle assembly within a rattle aperture within the buttstock body according to one or more embodiments shown and described herein.

FIGS. 4A, 4B, 5A, 5B and 5C depict the anti-rattle assembly 300 in relation to the buttstock body 400. As depicted by FIG. 4A, the buttstock body 400 may include a body axis B that runs longitudinally from a first end 435 to a second end 440 of the buttstock body 400. The tubular aperture 420 may include a tubular axis T that may be parallel to the body axis B and a groove 425, which the groove 425 is depicted in FIG. 4B. The groove 425 is operable to receive the alignment rail 200 of the receiver extension 115. The groove 425 may be along an outer tube wall 445 of the tubular aperture 420. The groove 425 may be at the opposite from the upper body portion 415 along the outer tube wall 445.

The locking pin 405 may be operable to removably secure the receiver extension 115 in relation to the buttstock body 400. The locking pin 405 may include a pin axis P that is orthogonal to the tubular axis T as depicted in FIG. 4A. The pin biasing spring 410 may provide a biasing force in an upward direction towards the groove 425 so that the locking pin 405 removable couples with the plurality of cavities 215 of the receiver extension 115. When the locking pin 405 is in an extended position, the locking pin 405 may be removably coupled with a cavity of the plurality of cavities 215. The coupling of the locking pin 405 and a cavity of the plurality of cavities 215 may restrict the movement of the receiver extension 115, as depicted in FIGS. 5A, 5B and 5C.

A lever 450 may be hingedly coupled to the locking pin 405 and may provide a lever force to retract the locking pin 405 from the cavity of the one or more cavities 215. A retracted position is defined when the lever 450 retracts the locking pin 405 from the cavity of the plurality of cavities 215. The retracted position allows the collapsible buttstock 105 to either be moved to another telescoping position or to allow the receiver extension 115 to be removed from the tubular aperture 420 of the collapsible buttstock 105. The pin biasing spring 410 biasing force may provide enough tension between the locking pin 405 and the lever 450 to ensure that the lever 450 does not move or slide when in a resting position. The pin biasing spring 410 also provides enough biasing force for the locking pin 405 to maintain the extended position. The resting position of the lever 450 may be when the locking pin 405 is in the extended position as it does not require any actuation to maintain the extended position. When the lever 450 is actuated in a first direction D (i.e. when a force is placed on the lever 450 in the first direction D as depicted by FIG. 4A), the locking pin 405 is placed in the retracted position. The retracted position allows the receiver extension 115 to be moved between cavities, i.e. telescoping position. However, the locking pin 405 is not retracted enough to remove it from the elongated slot 210 of FIG. 2. Therefore, the receiver extension 115 may still be captured by the buttstock body 400. Alternatively, when the lever 450 is actuated in a second direction E as shown in FIG. 4A, the locking pin is placed in a release position. The release position enables the receiver extension 115 to be removed from the tubular aperture 420.

In another embodiment, a retaining ring 455 may be coupled to the locking pin 405 to capture and secure the lever 450. In the illustrated embodiment, the lever 450 may be slideably coupled to the locking pin 405. The retaining ring 455 may be threaded onto the locking pin 405 to secure and couple the retaining ring 455 to the locking pin 405. In other embodiments, any suitable means for coupling the lever 450 to locking pin 405, such as gluing, welding, etc., may be used.

The plurality of fastener positions 460 (FIG. 4A) may be located around a perimeter wall 465 of a rattle aperture 470. The anti-rattle assembly 300 may be placed within the rattle aperture 470 of the buttstock body 400. The plurality of fasteners 320 of the baseplate 305 removably secure with the plurality of fastener positions 460 to secure the anti-rattle assembly 300 within the buttstock body 400. The one or more ridges 345 may protrude from the rattle aperture 470 into the groove 425 of the tubular aperture 420. This may allow for the pressure plate 340 to apply the biasing force from biasing members 325 to the receiver extension 115, via the one or more ridges 345*a*, 345*b* contacting the one or more rail surfaces 220*a* and 220*b*, respectively, of the receiver extension 115 (FIG. 2), to stop and/or restrict the movement of the receiver extension 115 within the tubular aperture 420.

FIGS. 5A, 5B and 5C depict the anti-rattle assembly 300 within the rattle aperture 470. As described above, in one embodiment, the plurality of fasteners 320 are coupled with the plurality of fastener positions 460 to secure the baseplate 305 to the buttstock body 400. The plurality of fasteners 320 may include at least one of the following, a barb fastener, a clip fastener, a rivet, a screw, a bolt and nut, an expansion bolt, a cantilever hook, a spring toggle, a turnbuckle, a pine in hole, a wedge in slot, a trap, a snap, a ball and socket, a cantilever spring, a crush rib, welding, brazing, solvent bonding, Velcro, a crimp, and a seam. The plurality of fastener apertures 360 include at one of the following fastener aperture operable to receive the fastener and a solid blank. The biasing members 325 may be captured and secured between the baseplate 305 and the pressure plate 340. The locking pin 405 is shown protruding into the a cavity of the plurality of cavities 215 while the locking pin 405 is in the extended position (e.g. resting position). The receiver extension 115 of FIG. 2 is shown inserted into the tubular aperture 420.

When the receiver extension 115 is inserted into the tubular aperture 420, the pressure plate 340 may be directed downward along the vertical axis V (FIG. 3) and partially or completely compress the biasing members 325. A ramp 520 as shown in FIGS. 4A and 5B, may be operable to move the pressure plate 340 in the downward direction as the receiver extension 115 is inserted into the tubular aperture 420. In other words, as the receiver extension 115 engages the ramp 520 of the pressure plate 340, the pressure plate 340 is directed down along vertical axis V of FIG. 3. A stop gap 510 may be created when the receiver extension 115 is inserted into the tubular aperture 420. The stop gap 510 is the space between the one or more upper stops 500 and the one or more lower stops 370 when the receiver extension 115 is inserted into the tubular aperture 420. Alternatively, with the receiver extension 115 removed from the tubular aperture 420, the one or more ridges 345 may fully protrude into the groove 425. The one or more upper stops 500 are in contact with the one or more lower stops 370 when the receiver extension 115 is removed from the tubular aperture 420 of the buttstock body 400. The contact between the one or more upper stops 500 and the one or more lower stops 370 may also serve to restrict the amount of pressure the biasing member 325 may exert on the receiver extension 115 when the receiver extension 115 is slideably coupled with the tubular aperture 420.

In another embodiment, the lever 450 may include features of the baseplate 305 to include the plurality of lower guides 310 and the plurality of fasteners to removably secure the anti-rattle assembly to the plurality of fastener positions within the rattle aperture of the buttstock body 400. In other words, the baseplate 305 is integral with the lever 450. The plate aperture 315 of the baseplate 305 may be disposed on the lever 450. The second plate aperture (not shown) of the pressure plate 340 may align with the plate aperture 315 of the lever 450 to define a through bore. It is to be appreciated that placing the locking pin 405 in the retracted position and/or the release position, lessens the biasing force applied by biasing members 325. In the retracted position, the lever 450 moved away from the buttstock body 400 and hence the pressure applied by the pressure plate 340 to the one or more rail surfaces 220*a*, 220*b* through the one or more ridges 345*a*, 345*b*, may be reduced as the biasing members 325 extend and/or relax. In other words, this lessening of the biasing force, and hence contact pressure, results from applying a force to the lever 450 in the first direction D, which creates spacing that likewise permits plurality of lower guides 310 to move away relatively from the pressure plate 340 via expansion of the biasing members 325*a*, 325*b*, basically simultaneously, when the locking pin 405 is place in the retracted position. This reduction of the pressure applied by the pressure plate 340 to the one or more rail surfaces 220*a*, 220*b*, is such that the pressure plate 340 will not hinder the movement of the collapsible buttstock 105 along the receiver extension 115. Likewise, when the locking pin 405 is in the extended position, i.e., normal resting position, the lever 450 closes the spacing between the plurality of lower guides 310 and the pressure plate 340, via pin biasing spring 410 providing a biasing force on the locking pin 405 in the upward direction and which results in the locking pin 405 and the pressure plate 340 engaging in at least two different places and at least under two different biasing forces, via biasing members 410, 325, the receiver extension 115 as is depicted by FIG. 5A.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Certain terminology is used in the disclosure for convenience only and is not limiting. The words "left", "right", "front", "back", "top", "bottom", "upper", and "lower", "vertical", and "horizontal" designate directions in the drawings to which reference is made. The terminology includes the words noted above as well as derivatives thereof and words of similar import.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. An anti-rattle assembly for a collapsible buttstock for a firearm, comprising:

a baseplate with a plurality of lower guides and a plurality of fasteners wherein the plurality of fasteners removably secure the anti-rattle assembly to a plurality of fastener positions of a buttstock body;

a pressure plate with one or more ridges to engage one or more rail surfaces of a receiver extension and a plurality of upper guides;

a plurality of biasing members wherein the pressure plate is vertically aligned with the baseplate and the plurality of biasing members are coupled between the plurality of upper guides and the plurality of lower guides and bias the one or more ridges against the one or more rail surfaces; and wherein the anti-rattle assembly restricts a movement of the receiver extension in a tubular aperture of the buttstock body.

2. The anti-rattle assembly of claim 1, wherein the buttstock body further comprises one or more upper stops and wherein the pressure plate comprises one or more lower stops that engage the one or more upper stops to restrict a pressure of the one or more ridges against the one or more rail surfaces.

3. The anti-rattle assembly of claim 1, wherein the plurality of fasteners include at least one of the following, a barb fastener, a clip fastener, a rivet, a screw, a bolt and nut, an expansion bolt, a cantilever hook, a spring toggle, a turnbuckle, a pine in hole, a wedge in slot, a trap, a snap, a ball and socket, a cantilever spring, a crush rib, welding, brazing, solvent bonding, Velcro, a crimp, or a seam, and wherein the plurality of fastener positions include at least one of the following, an fastener aperture operable to receive the plurality of fasteners or a solid blank.

4. The anti-rattle assembly of claim 1, wherein the plurality of biasing members include at least one of the following, a spring, a compressible foam, a compressible gel, or a fluid.

5. The anti-rattle assembly of claim 1, wherein the baseplate further comprises a plate aperture to allow a locking pin to slideably couple with the baseplate.

6. The anti-rattle assembly of claim 5, wherein the baseplate further comprises a lower pin biasing guide for a pin biasing spring, the pin biasing spring applying a biasing for on the locking pin.

7. A method of reducing movement in a collapsible buttstock, comprising:

applying pressure on a receiver extension inserted into a tubular aperture of a buttstock body by using an anti-rattle kit comprising:

a baseplate with a plurality of lower guides and a plurality of fasteners wherein the plurality of fasteners removably secure the anti-rattle kit to a plurality of fastener positions of the buttstock body;

a pressure plate with one or more ridges to engage one or more rail surfaces of the receiver extension and a plurality of upper guides; and a plurality of biasing members wherein the pressure plate is vertically aligned with the baseplate and the plurality of biasing members are coupled between the plurality of upper guides and the plurality of lower guides and bias the one or more ridges against the one or more rail surfaces;

aligning an upper tube portion of the receiver extension with an upper body portion of the tubular aperture with the applied pressure to reduce a movement of the buttstock body in relation to the receiver extension; and maintaining the alignment a tubular axis of the buttstock body with a firearm axis.

8. The method of reducing movement of claim 7, wherein the buttstock body further comprises one or more upper stops and wherein the pressure plate comprises one or more lower stops that engage the one or more upper stops to restrict the pressure of the one or more ridges against the one or more rail surfaces.

9. The method of reducing movement of claim 7, wherein the plurality of fasteners include at least one of the following, a barb fastener, a clip fastener, a rivet, a screw, a bolt and nut, an expansion bolt, a cantilever hook, a spring toggle, a turnbuckle, a pine in hole, a wedge in slot, a trap, a snap, a ball and socket, a cantilever spring, a crush rib, welding, brazing, solvent bonding, Velcro, a crimp, or a seam, and wherein the plurality of fastener positions include at least one of the following, an fastener aperture operable to receive the plurality of fasteners or a solid blank.

10. The method of reducing movement of claim 7, wherein the plurality of biasing members include at least one of the following, a spring, a compressible foam, a compressible gel, or a fluid.

11. The method of reducing movement of claim 7, wherein the baseplate further comprises a plate aperture to allow a locking pin to slideably couple with the baseplate.

12. The method of reducing movement of claim 11, wherein the baseplate further comprises a lower pin biasing guide for a pin biasing spring, the pin biasing spring applying a biasing for on the locking pin.

13. A collapsible buttstock assembly, comprising:

a receiver extension having an outer an alignment rail extending longitudinally along the receiver extension and comprising an elongated slot with a plurality of cavities spaced apart at regular intervals and one or more rail surfaces spanning a length of the alignment rail wherein each rail surface is situated on either side of the plurality of cavities;

a buttstock body comprising:

a body axis that runs longitudinally from a first end to a second end, a tubular aperture with a tubular axis and a groove parallel with the tubular axis and is situated along an outer tube wall of the tubular aperture, the tubular axis is parallel to the body axis, and wherein the tubular axis receives the receiver extension, a locking pin situated in a pin aperture with a pin axis that orthogonally penetrates the groove and wherein the locking pin in an extended position engages a cavity of the plurality of cavities and restricts a movement of the receiver extension, a pin biasing spring that biases the locking pin into the groove, a lever coupled to the locking pin wherein when the lever is actuated in a first direction, the locking pin is in retracted position and when the lever is in a resting state, the locking pin is in the extended position, and a plurality of fastener positions located around a perimeter wall of a rattle aperture; and an anti-rattle assembly having:

a baseplate with a plurality of lower guides and a plurality of fasteners to removably secure the anti-rattle assembly to the plurality of fastener positions within the rattle aperture of the buttstock body, a pressure plate with one or more ridges to engage the one or more rail surfaces, and a plurality of upper guides, and a plurality of biasing members wherein the pressure plate is vertically aligned with the baseplate and the plurality of biasing members are coupled between the plurality of upper guides and the plurality of lower guides, and bias the one or more ridges against the one or more rail surfaces.

14. The anti-rattle assembly of claim 13, wherein the buttstock body further comprises one or more upper stops and wherein the pressure plate comprises one or more lower stops that engage the one or more upper stops to restrict a pressure of the one or more ridges against the one or more rail surfaces.

15. The anti-rattle assembly of claim 13, wherein the plurality of fasteners include at least one of the following, a barb fastener, a clip fastener, a rivet, a screw, a bolt and nut, an expansion bolt, a cantilever hook, a spring toggle, a turnbuckle, a pine in hole, a wedge in slot, a trap, a snap, a ball and socket, a cantilever spring, a crush rib, welding, brazing, solvent bonding, Velcro, a crimp, or a seam, and wherein the plurality of fastener positions include at least one of the following, an fastener aperture operable to receive the plurality of fasteners or a solid blank.

16. The anti-rattle assembly of claim 13, wherein the plurality of biasing members include at least one of the following, a spring, a compressible foam, a compressible gel, or a fluid.

17. The anti-rattle assembly of claim 13, wherein the baseplate further comprises a plate aperture to allow the locking pin to slideably couple with the baseplate.

18. The anti-rattle assembly of claim 17, wherein the baseplate further comprises a lower pin biasing guide for the pin biasing spring, the pin biasing spring applying a biasing for on the locking pin.

19. The anti-rattle assembly of claim 13, wherein the baseplate is integral with the lever.

* * * * *

UNITED STATES PATENT AND TRADEMARK OFFICE

CERTIFICATE OF CORRECTION

PATENT NO. : 8,978,285 B1
APPLICATION NO. : 13/971341
DATED : March 17, 2015
INVENTOR(S) : Judd Burke et al.

It is certified that error appears in the above-identified patent and that said Letters Patent is hereby corrected as shown below:

Claims

Col. 9, Claim 3, Line 34,
"following, an fastener aperture operable to receive the plural-" should read
--following, a fastener aperture operable to receive the plural- --;

Col. 9, Claim 6, Line 45,
"on the locking pin." should read
--the locking pin.--;

Col. 10, Claim 7, Line 1,
"maintaining the alignment a tubular axis of the buttstock" should read
--maintaining the alignment of a tubular axis of the buttstock--;

Col. 10, Claim 9, Line 18,
"following, an fastener aperture operable to receive the plural-" should read
--following, a fastener aperture operable to receive the plural- --;

Col. 10, Claim 12, Line 30,
"a biasing for on the locking pin." should read
--a biasing for the locking pin.--;

Col. 10, Claim 13, Line 32,
"a receiver extension having an outer an alignment rail" should read
--a receiver extension having an outer alignment rail--;

Col. 12, Claim 15, Line 2,
"following, an fastener aperture operable to receive the plural-" should read
--following, a fastener aperture operable to receive the plural- --; and Signed and Sealed this
Twenty-fourth Day of November, 2015

Michelle K. Lee

Michelle K. Lee
*Director of the United States Patent and Trademark Office*

Claims

Col. 12, Claim 18, Line 15,
"on the locking pin." should read
--the locking pin.--.